US012320027B2

(12) United States Patent
Leonhard et al.

(10) Patent No.: US 12,320,027 B2
(45) Date of Patent: Jun. 3, 2025

(54) MEMBRANE ANODE SYSTEM FOR ELECTROLYTIC ZINC-NICKEL ALLOY DEPOSITION

(71) Applicant: Atotech Deutschland GmbH, Berlin (DE)

(72) Inventors: Steven Leonhard, Berlin (DE); Thomas Freese, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 353 days.

(21) Appl. No.: 17/422,877

(22) PCT Filed: Jan. 22, 2020

(86) PCT No.: PCT/EP2020/051482

§ 371 (c)(1),
(2) Date: Jul. 14, 2021

(87) PCT Pub. No.: WO2020/152208

PCT Pub. Date: Jul. 30, 2020

(65) Prior Publication Data

US 2022/0119978 A1 Apr. 21, 2022

(30) Foreign Application Priority Data

Jan. 24, 2019 (EP) ..... 19153419

(51) Int. Cl.

| | |
|---|---|
| ***C25D 3/56*** | (2006.01) |
| ***C25D 3/22*** | (2006.01) |
| ***C25D 17/00*** | (2006.01) |
| ***C25D 17/10*** | (2006.01) |
| ***C25D 21/12*** | (2006.01) |
| ***C25D 21/18*** | (2006.01) |

(52) U.S. Cl.

CPC ..... *C25D 17/002* (2013.01); *C25D 3/22* (2013.01); *C25D 17/10* (2013.01); *C25D 21/12* (2013.01); *C25D 21/18* (2013.01)

(58) Field of Classification Search

CPC ..... C25D 3/562; C25D 3/565
USPC ..... 205/246, 255
See application file for complete search history.

(56) References Cited

U.S. PATENT DOCUMENTS

| | | | | |
|---|---|---|---|---|
| 5,047,128 | A * | 9/1991 | Hawkins | C25D 21/18 204/519 |
| 2005/0189231 | A1* | 9/2005 | Capper | C25D 3/565 420/513 |
| 2006/0124454 | A1 | 6/2006 | Wurm et al. | |
| 2006/0163072 | A1* | 7/2006 | Baskaran | C25D 21/12 205/67 |
| 2011/0031127 | A1 | 2/2011 | Hillebrand | |
| 2013/0264215 | A1 | 10/2013 | Weyhmueller et al. | |
| 2016/0024683 | A1* | 1/2016 | Dingwerth | C25D 17/002 205/244 |
| 2017/0016137 | A1 | 1/2017 | Wilson et al. | |
| 2018/0087177 | A1* | 3/2018 | Trenkner | C25D 3/56 |

FOREIGN PATENT DOCUMENTS

| | | | | |
|---|---|---|---|---|
| DE | 4015141 | A1 * | 11/1991 | C25D 21/14 |
| DE | 102010044551 | A1 * | 3/2012 | C25D 17/002 |
| DE | 202015002289 | U1 | 5/2015 | |
| GB | 2103658 | A | 2/1983 | |
| JP | 5893893 | A | 6/1983 | |
| JP | 4176893 | A | 6/1992 | |
| JP | 08232081 | A * | 9/1996 | C23C 28/023 |
| JP | 11343598 | A | 12/1999 | |
| WO | WO-0196631 | A1 * | 12/2001 | C25D 17/10 |
| WO | WO-2004013381 | A2 * | 2/2004 | C25D 21/18 |
| WO | 2004059045 | A2 | 7/2004 | |
| WO | 2009124393 | A1 | 10/2009 | |
| WO | WO-2015120963 | A1 * | 8/2015 | B01D 61/422 |

OTHER PUBLICATIONS

PCT/EP2020/051482 International Search Report and Written Opinion of the International Searching Authority dated Mar. 18, 2020.

* cited by examiner

*Primary Examiner* — Edna Wong

(74) *Attorney, Agent, or Firm* — Renner, Otto, Boisselle & Sklar, LLP

(57) ABSTRACT

The present invention is related to a membrane anode system for electrolytic zinc-nickel alloy deposition, a method for electrolytic deposition of a zinc-nickel alloy layer on a substrate to be treated using a membrane anode system, and the use of a membrane anode system for acid or alkaline electrolytic deposition of a zinc-nickel alloy layer on a substrate to be treated by such a method.

18 Claims, No Drawings

MEMBRANE ANODE SYSTEM FOR ELECTROLYTIC ZINC-NICKEL ALLOY DEPOSITION

This application is a national phase of International Application No. PCT/EP2020/051482 filed 22 Jan. 2020, which claims priority to European Patent Application No. 19153419.7 filed 24 Jan. 2019, the entireties of which are hereby incorporated by reference.

FIELD OF THE INVENTION

The present invention relates to a membrane anode system for electrolytic zinc-nickel alloy deposition.

The present invention is further directed to a method for electrolytic deposition of a zinc-nickel alloy layer on a substrate to be treated using a membrane anode system, and the use of a membrane anode system for acid or alkaline electrolytic deposition of a zinc-nickel alloy layer on a substrate to be treated by such a method.

BACKGROUND OF THE INVENTION

The electrochemical deposition of metals or metal alloys, referred to as coatings, on other metals or metal-coated plastics is an established technique for upgrading, decorating and increasing the resistance of surfaces (Praktische Galvanotechnik, Eugen G. Leuze Verlag). The electrochemical deposition of metals or metal alloys is usually carried out using anodes and cathodes which dip into an electrolysis cell filled with electrolyte. On application of an electric potential between these two electrodes (anode and cathode), metals or metal alloys are deposited on the substrate (cathode).

In some cases, this construction is varied and an electrolysis cell in which the electrolyte is divided by means of a semipermeable membrane into a catholyte compartment (electrolyte in the cathode space) and an anolyte compartment (electrolyte in the anode space) is provided. The substrate (cathode) dips herein into the catholyte containing the metal ions to be deposited. On application of an electric potential, current flows via the anolyte through the membrane into the catholyte.

US 2017/016137 A1 refers to an electroplating processor for plating copper on wafers, wherein an inert anode in the vessel has an anode wire within an anode membrane tube.

WO 2004/013381 A2 discloses an electrochemical plating system for copper electrodeposition, the system comprising a plating cell, wherein the plating cell generally includes an ion-exchange membrane disposed between an anolyte compartment and a catholyte compartment.

WO 2009/124393 A1 refers to an electrochemical process for the recovery of metallic iron and sulfuric acid values from iron-rich sulfate wastes, mining residues and pickling liquors.

WO 2004/059045 A2 refers to an anode used for electroplating comprising a basic member and a shield, wherein the shield preferably comprises a membrane.

GB 2103658 A refers to an electrolytic apparatus comprising a cathode and an anode with an ion-exchange membrane positioned therebetween.

DE 20 2015 002 289 U1 discloses in a method for electrolytic deposition of a zinc-nickel alloy an anode system comprising a membrane.

US2011031127 A1 (Hillebrand) discloses an alkaline electroplating bath for plating zinc-nickel coatings, having an anode and a cathode, wherein the anode is separated from the alkaline electrolyte by an ion exchange membrane.

However, in such "classical approaches" for plating zinc-nickel coatings the distance between the membrane and the respective anode is large in order to provide enough anolyte volume to ensure a sufficient flow of current. Such a large space requirement for the anolyte compartment is often not available. Additionally, it requires the provision of a high volume of anolyte leading to a huge effort for the subsequent waste water treatment if the anolyte has to be replaced for maintenance reasons. The anolyte is commonly an aqueous solution having certain amounts of sulfuric acid comprised, in particular ten percent of sulfuric acid in water.

In an alternative approach thereto, US 2013/0264215 A1 (Umicore) discloses an anode system, which is configured in such a way that it is suitable for use in electroplating cells for the deposition of electrolytic coatings as a result of simple dipping into the catholyte, wherein, after dipping into the catholyte, the catholyte is separated from the anode by swollen polymer membrane which is permeable to cations or anions and the polymer membrane is in direct contact with the anode and not with the cathode, wherein the membrane is fixed onto the anode by means of electrolyte-permeable holders and pressing devices by means of a multiplayer structure, which ensures good contact of the membrane with the anode.

Said alternative system, which works without any anolyte space, has attempted to simplify existing membrane electrolysis systems so that the system can be implemented directly in existing plants without costly modification work. Polymer membranes usable therefore should be capable of establishing direct contact with the anode ideally over the entire surface. It is important that ideally direct contact with the anode is established, i.e. there must preferably be no gap between the membrane and the anode material. In the case of very close bonding between polymer membrane and anode, an advantageous flow of current is given, which results in a lower cell voltage.

However, the industrial applicability of such a system without any anolyte compartment is very limited to specific small scale electrolytic processes, such as gold deposition baths, which run solely with 0.5 ampere for 2 hours per day. Then, the diffusion of ions through the swollen polymer membrane is sufficient. But, if the application requires longer application times, such as for industrial zinc-nickel deposition processes (commonly requires up to 10 000 ampere hours per day), a swollen polymer membrane without anolyte compartment is not capable to provide enough ions constantly to keep the deposition process running.

OBJECTIVE OF THE PRESENT INVENTION

In view of the prior art, it was thus an object of the present invention to provide a membrane anode system and a method for electrolytic zinc-nickel alloy deposition, which shall not exhibit the aforementioned shortcomings of the known prior art systems.

In particular, it was an object of the present invention to provide a membrane anode system and a deposition method which shall be able to deposit zinc-nickel alloy layers on a substrate to be treated while at the same time the volume of anolyte should be minimized.

Further, it was an object of the present invention to provide a membrane anode system and a deposition method wherein the huge costs of waste water treatment shall be minimized or even ideally completely avoided.

SUMMARY OF THE INVENTION

These objects and also further objects which are not stated explicitly but are immediately derivable or discernible from the connections discussed herein by way of introduction are achieved by a membrane anode system having the features described herein. Appropriate modifications to the inventive membrane anode system are described in addition. Further disclosed is a method for electrolytic deposition of a zinc-nickel alloy layer on a substrate to be treated using such an inventive membrane anode system. Appropriate modifications of said method are disclosed herein. Furthermore, disclosed is the use of such a membrane anode system for acid or alkaline electrolytic deposition of a zinc-nickel alloy layer on a substrate to be treated by such a method.

The present text generally refers to a membrane anode system for electrolytic zinc-nickel alloy deposition characterized in that the system comprises at least a reaction tank, at least a first membrane, at least an anode, at least a cathode, at least a first anolyte compartment, and at least a catholyte compartment; wherein the at least first membrane is arranged between the anode and the cathode, wherein the at least first membrane has a distance to the anode ranging from 0.5 mm to 5 mm, preferably from 0.75 mm to 4 mm, and more preferably from 1 mm to 3 mm.

However, the present invention refers to a membrane anode system for electrolytic zinc-nickel alloy deposition comprising at least a reaction tank,
at least a first membrane,
at least an anode,
at least a cathode,
at least a first anolyte compartment, and
at least a catholyte compartment;

wherein the at least first membrane is arranged between the anode and the cathode, wherein the at least first membrane has a distance to the anode ranging from 0.5 mm to 5 mm, characterized in that the membrane anode system further comprises at least a first non-metallic front plate having a plurality of openings and at least a non-metallic container, wherein said at least first non-metallic front plate and said non-metallic container form together with the at least first membrane, the anode, and the at least first anolyte compartment between the first membrane and the anode, at least a one-side membrane anode modular unit, and the anode can be individually removed from or inserted into the at least one-side membrane anode modular unit without that the entire at least one-side membrane anode modular unit has to be removed from or inserted into the reaction tank.

Preferred is a membrane anode system of the present invention characterized in that the at least first membrane has a distance to the anode ranging from 0.75 mm to 4 mm, preferably from 1 mm to 3 mm.

It is thus possible in an unforeseeable manner to provide a membrane anode system for electrolytic zinc-nickel alloy deposition, which does not exhibit the aforementioned shortcomings of the known prior art systems.

In addition thereto, a membrane anode system is provided which is able to deposit zinc-nickel alloy layers on a substrate to be treated while at the same time the volume of anolyte is minimized.

Furthermore, a membrane anode system is provided wherein the huge costs of waste water treatment are minimized or even ideally completely avoided.

The decreasing of the distance between the membrane and the respective anode, which defines the volume of the anolyte compartment, is offering said above-cited advantages over the cited prior art, namely a high reduction of the anolyte volume itself and concluding thereof a high reduction of the anolyte volume, which has to be treated in a subsequently arranged waste water treatment apparatus.

It has been surprisingly found that the reduction of the distance to such a low distance offers the further advantage that such a membrane anode system need much less installation space compared to the "classical approach" of Hillebrand, which comprises huge amounts of anolyte volume compared hereto.

On the industrial scale applications, a Hillebrand anolyte volume to be treated in a subsequently arranged waste water treatment apparatus is commonly chosen to be between 1000 l and 3000 l for a zinc-nickel deposition process, while the inventive membrane anode system comprises an anolyte volume to be treated in a subsequently arranged waste water treatment apparatus of just 100 l.

On the industrial scale applications, in a Hillebrand membrane anode system the distance between the respective membrane and the anode is around 45 mm, while the distance herein is much smaller (5 mm maximum).

This offers the additional advantage that the dimensions of the entire membrane anode system can be minimized.

DETAILED DESCRIPTION OF THE INVENTION

As used herein, the term "membrane anode system", when applied for electrolytic zinc-nickel alloy deposition in accordance with the present invention, refers to a system, which comprises at least a reaction tank, at least a membrane, at least an anode and at least a cathode. These fundamental parts of such a system are always used in membrane based electrolytic zinc-nickel alloy deposition systems.

Herein, the arrangement of the membrane defines the parts of the reaction tank, which represent the anolyte compartment and the catholyte compartment. This nomenclature is commonly used in the electroplating industry for a membrane based system working with anodes and cathodes (most commonly the substrates to be treated).

The present invention has been found to be suitable (membrane anode system and method for deposition, both) for barrel and rack plating processes.

As used herein, the term "distance", when applied for electrolytic zinc-nickel alloy deposition in accordance with the present invention, refers to the distance between the site of a surface of the anode and the site of an oppositely arranged surface of a membrane being closest together.

Herein, it is advantageous to make use of flat anodes, which are arranged in a parallel manner to the respective membrane in order to provide a constant distance of the respective surface of the anode to the respective membrane.

Herein, it is further advantageous to make use of flat membranes, which are arranged in a parallel manner to the anode, preferably to a flat anode, in order to provide a constant distance of the respective surface of the anode, preferably of a flat anode, to the respective membrane, preferably to the flat membrane.

In the most preferred embodiment, a flat membrane is arranged in a parallel manner to a flat anode leading to a constant distance between the respective surfaces of the membrane and the anode over the entire respective surfaces of the membrane and the anode, which are oppositely arranged against each other.

The above-cited variations of anodes and membranes are of course also suitable and provided for all other embodiments of the present invention, even when not explicitly repeated for each further embodiment in the following.

According to the general disclosure of the present text, the membrane anode system further preferably comprises at least a first non-metallic front plate having a plurality of openings and at least a non-metallic container, wherein said at least first non-metallic front plate and said non-metallic container form together with the at least first membrane, the anode, and the at least first anolyte compartment between the first membrane and the anode, at least a one-side membrane anode modular unit.

Preferred is a membrane anode system of the present invention, wherein the at least one-side membrane anode modular unit provides at least a first encapsulation of the at least first membrane, the at least first anolyte compartment and the anode by encapsulating the at least first non-metallic front plate with the non-metallic container; wherein the at least one-side membrane anode modular unit further comprises at least a first sealing element, which is sealing said at least first encapsulation of said at least first non-metallic front plate with said non-metallic container.

This offers the advantage that such a one-side membrane anode modular unit provides a very compact design and facilitates maintenance work such as replacements by removing or inserting the entire one-side membrane anode modular unit from or into the reaction tank.

Such a one-side membrane anode modular unit is provided in such a way that ions can pass through the plurality of openings of the at least first non-metallic front plate, normally made of PP (polypropylene), to reach the at least first membrane and to migrate through said at least first membrane to arrive at the at least first anolyte compartment; and vice versa.

In a preferred embodiment, the membrane anode system further comprises at least a second non-metallic front plate having a plurality of openings, at least a second membrane, and at least a second anolyte compartment between the at least second membrane and the anode; wherein the anode comprises at least a first side comprising a first anode surface and at least a second side comprising a second anode surface, wherein the first side of the anode is oppositely arranged to the second side of the anode; wherein on the first side of the anode the at least first membrane and the at least first non-metallic front plate are arranged in a parallel manner to the surface of said first side of the anode while on the second side of the anode the at least second membrane and the at least second non-metallic front plate are arranged in a parallel manner to the surface of said second side of the anode; wherein the at least first and second membrane together with the at least first and second non-metallic front plate, the non-metallic container, the at least first and second anolyte compartment, and the anode form together at least a two-side membrane anode modular unit.

In a preferred embodiment thereof, the at least two-side membrane anode modular unit provides at least a first encapsulation of the at least first membrane, the at least first anolyte compartment and the anode by encapsulating the at least first non-metallic front plate with the non-metallic container; wherein the at least two-side membrane anode modular unit further comprises at least a first sealing element, which is sealing said at least first encapsulation of said at least first non-metallic front plate with said non-metallic container; and wherein the at least two-side membrane anode modular unit further provides at least a second encapsulation of the at least second membrane, the at least second anolyte compartment and the anode by encapsulating the at least second non-metallic front plate with the non-metallic container; wherein the at least two-side membrane anode modular unit further comprises at least a second sealing element, which is sealing said at least second encapsulation of said at least second non-metallic front plate with said non-metallic container.

This offers the advantage that such a two-side membrane anode modular unit provides a very compact design and facilitates maintenance work such as replacements by removing or inserting the entire two-side membrane anode modular unit from or into the reaction tank. Additionally to the one-side membrane anode modular unit described above, it offers the further advantage that such an even more compact design allows making use of two membranes being in conjunction with just one two-side membrane anode modular unit, namely one on each side of the two-side membrane anode modular unit. This reduces further the space requirements for such a system by saving an entire anode.

According to the general disclosure of the present text, the anode can preferably be individually removed from or inserted into the at least one-side membrane anode modular unit or the at least two-side membrane anode modular unit without that the entire at least one-side membrane anode modular unit or the entire at least two-side membrane anode modular unit has to be removed from or inserted into the reaction tank.

In the membrane anode system of the present invention the anode can be individually removed from or inserted into the at least one-side membrane anode modular unit without that the entire at least one-side membrane anode modular unit has to be removed from or inserted into the reaction tank.

Preferred is a membrane anode system of the present invention characterized in that the anode can be individually removed from or inserted into the at least two-side membrane anode modular unit without that the entire at least two-side membrane anode modular unit has to be removed from or inserted into the reaction tank. This applies to the at least two-side membrane anode modular unit.

In the context of the present invention, this "can be" denotes "is adapted such that the anode is individually removed from or inserted into the [respective modular unit]".

Such an embodiment offers a facilitated possibility to open a small number of fastening elements, which are comprised herein, such as a small number of screws, for removing or inserting just the anode. This enables a much easier maintenance and replacement of used anodes than being forced to remove and insert the entire membrane anode system, in particular the entire one-side or two-side membrane anode modular unit, from or into the reaction tank.

In one embodiment, each membrane is not in direct contact with each anode.

The given ranges of the distance between the membrane and the anode according to the present invention are limited on the side of the lower limit only to constructional circumstances. At a certain distance (given by the lower limit of the ranges claimed), it will be too challenging still to ensure a provision of enough anolyte volume between the membrane and the anode to keep the system running. A small anolyte liquid film on the surface of the anode has to be kept in order to keep the process running. Thus, this embodiment expresses again that this invention is not focusing on providing a direct contact membrane anode as Umicore (see background of the invention above) offers it.

In one embodiment, each membrane is a cation ion-exchange membrane and/or wherein each anode is an insoluble anode, preferably iridium coated mixed metal oxide anode.

Further, the object of the present invention is also solved by a method for electrolytic deposition of a zinc-nickel alloy layer on a substrate to be treated characterized in that the method uses at least a membrane anode system comprising at least a reaction tank,
at least a first membrane,
at least an anode,
at least a cathode,
at least a first anolyte compartment, and
at least a catholyte compartment;

characterized in that the at least first membrane is arranged between the anode and the cathode, wherein the at least first membrane has a distance to the anode ranging from 0.5 mm to 5 mm.

The aforementioned regarding the membrane anode system of the present invention preferably applies likewise to the method of the present invention.

Preferred is a method of the present invention, wherein the at least first membrane has a distance to the anode ranging from 0.75 mm to 4 mm, more preferably from 1 mm to 3 mm.

More preferred is a method of the present invention, wherein the membrane anode system is the membrane anode system of the present invention, most preferably as defined above as being preferred.

A method as described above offers the advantages as described above for the different embodiments of the respective inventive membrane anode system. Additionally, such a method enables the miniaturization of supporting equipment, such as pumps, caused by the largely decreased anolyte volume, which is defined by the largely decreased distance from membrane to anode compared to the Hillebrand technology.

In a preferred embodiment of the method, the method comprises at least an anolyte feeding system for controlling and/or regulating of at least an anolyte volume flow for providing at least an anolyte to the at least first anolyte compartment or to the at least first and second anolyte compartments of the membrane anode system; wherein said anolyte feeding system comprises at least an anolyte tank, at least a dosing pump, and at least a dosing nozzle; wherein the anolyte volume flow is running from the anolyte tank to the dosing pump, further to the dosing nozzle, and further to the at least first anolyte compartment or to the at least first and second anolyte compartments of the membrane anode system.

Such an anolyte feeding system offers the advantage that the anolyte tank can be chosen much smaller compared to the Hillebrand technology caused by the largely reduced anolyte volume (see above the explanations about waste water treatment; around 100 l instead 1000 l to 3000 l). Customers are often obliged to exchange the entire anolyte tank once a week. This highlights that a reduction of 1000 l or 3000 l to 100 l highly reduces costs for the anolyte chemistry itself as well as for the subsequently required waste water treatment at customer's site.

In a more preferred embodiment of the method, the anolyte feeding system is not using flow meters and ball valves for controlling and/or regulating the anolyte volume flow.

This more preferred embodiment saves cost for the customer by avoiding the costly flow meters and ball valves. The dosing nozzles provide a constant high anolyte volume pressure in the respective anolyte conducting lines from the dosing pump to the anolyte compartment of the membrane anode system, which enables a constant and safe supporting of a plurality, preferably up to 100, membrane anode systems in an electrolytic zinc-nickel depositing method.

In a preferred embodiment of the method, the anolyte volume flow is controlled and/or regulated in such a way that the anolyte feeding system is a closed circulating system, wherein the anolyte volume flow after leaving again the at least first anolyte compartment or the at least first and second anolyte compartments of the membrane anode system flows back to the initial anolyte tank.

Such an anolyte feeding system offers the advantage that a waste water treatment becomes irrelevant and negligible, which saves enormous cost at customer's site.

In a preferred embodiment of the method, the anolyte is an aqueous liquid, preferably pure distilled water.

This embodiment of the invention offers the advantage of avoiding the use of chemistry and using instead in the ideal case pure distilled water (green technology). Such a usage of pure distilled water has not been executed up to now because the distance between the membrane and the anode has been always much higher (around 50 mm at Hillebrand) or even less (0 mm at Umicore). If the distance is chosen above the upper limit given in claim 1, the distance is too high for making use of pure distilled water, which possesses a too low electrical conductivity to be able to initiate the electrolytic deposition method. The initial current would be close to zero leading to a failure in producing enough hydrogen ions from the water. This highlights that the distance ranges claimed in claim 1 are not randomly chosen, but are required for this inventive system and method.

In a preferred embodiment of the method, the anolyte is substantially free of any acids, preferably completely free of acids, in particular free of mineral acids, especially free of sulfuric acid.

Commonly used anolytes comprise between 5 and 10% sulfuric acid instead of pure distilled water. Very often, the necessary manpower is no more available at customer's site to take care about the concentration of sulfuric acid in the anolyte. Customer's normally like to have automated systems, which run without any maintenance requirements, such as adding from time to time sulfuric acid to keep the respective concentration in the anolyte in the required range.

Additionally, such an inventive membrane anode system can be used for acid or alkaline electrolytic deposition of a zinc-nickel alloy layer on a substrate to be treated by executing such an inventive method.

The present invention refers to a use of a membrane anode system comprising at least a reaction tank,
at least a first membrane,
at least an anode,
at least a cathode,
at least a first anolyte compartment, and
at least a catholyte compartment characterized in that the at least first membrane is arranged between the anode and the cathode, wherein the at least first membrane has a distance to the anode ranging from 0.5 mm to 5 mm, for acid or alkaline electrolytic deposition of a zinc-nickel alloy layer on a substrate to be treated by a method according to the present invention (preferably as defined as being preferred).

The aforementioned regarding the membrane anode system of the present invention and the method of the present invention preferably applies likewise to the use of the present invention.

Preferred is a use of the present invention, wherein the at least first membrane has a distance to the anode ranging from 0.75 mm to 4 mm, more preferably from 1 mm to 3 mm.

More preferred is a use of the present invention, wherein the membrane anode system is the membrane anode system of the present invention, most preferably the membrane anode system as defined above as being preferred.

The present invention thus addresses the problem of minimizing the required volume of anolyte leading to a minimized effort for waste water treatment, ideally even to an avoiding of waste water treatment at all, while at the same time in a preferred embodiment of the present invention pure distilled water without any amount of sulfuric acid can be used as anolyte, which has never been possible up to now.

While the principles of the invention have been explained in relation to certain particular embodiments, and are provided for purposes of illustration, it is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the appended claims.

The invention claimed is:

1. Method for electrolytic deposition of a zinc-nickel alloy layer on a substrate to be treated characterized in that the method comprises:

providing a membrane anode system comprising:

at least one reaction tank, at least one first membrane, at least one anode, at least one cathode, at least one first anolyte compartment formed between the at least one first membrane and the at least one anode;

at least one first non-metallic front plate having a plurality of openings;

at least one non-metallic container, at least one first sealing element, and at least one catholyte compartment formed between the at least one first non-metallic front plate and the at least one cathode, wherein the at least one catholyte compartment contains a zinc and nickel electrolyte solution;

wherein the membrane anode system is characterized in that the at least one first membrane is arranged between the at least one anode and the at least one cathode, wherein the at least one first membrane has a distance to the at least one anode ranging from 0.5 mm to 5 mm, and wherein the at least one first membrane, the at least one anode, the at least one first anolyte compartment, the at least one first non-metallic front plate, the at least one first non-metallic container, and the at least one first sealing element form together a one-sided membrane anode modular unit, wherein the at least one first membrane, the at least one first anolyte compartment, and the at least one anode are encapsulated by the combination of the at least one first non-metallic front plate and the at least one first non-metallic container, wherein the at least one first non-metallic front plate and the at least one non-metallic container are sealed to each other by the at least one sealing element, and wherein the at least one anode can be individually removed from or inserted into the one-sided membrane anode modular unit without that the entire at least one-sided membrane anode modular unit has to be removed from or inserted into the at least one reaction tank, and applying a current between the anode and the cathode to deposit the zinc-nickel alloy layer on the substrate.

2. Method for electrolytic deposition of a zinc-nickel alloy layer on a substrate to be treated as recited in claim 1 characterized in that the at least one-sided membrane anode modular unit provides at least a first encapsulation of the at least one first membrane, the at least one first anolyte compartment and the at least one anode by encapsulating the at least one first non-metallic front plate with the at least one non-metallic container; wherein the first sealing element is sealing said at least first encapsulation of said at least one at least one first non-metallic front plate with said at least one non-metallic container.

3. Method for electrolytic deposition of a zinc-nickel alloy layer on a substrate to be treated as recited in claim 1 characterized in that the membrane anode system further comprises at least a second non-metallic front plate having a plurality of openings, at least a second membrane, and at least a second anolyte compartment between the at least second membrane and the at least one anode; wherein the at least one anode comprises at least a first side comprising a first anode surface and at least a second side comprising a second anode surface, wherein the first side of the at least one anode is oppositely arranged to the second side of the at least one anode; wherein on the first side of the at least one anode the at least first membrane and the at least one first non-metallic front plate are arranged in a parallel manner to the surface of said first side of the at least one anode while on the second side of the at least one anode the at least second membrane and the at least second non-metallic front plate are arranged in a parallel manner to the surface of said second side of the anode; wherein the at least one first and the second membranes together with the at least one first and the second non-metallic front plates, the at least one non-metallic container, the at least one first and the second anolyte compartments, and the at least one anode form together at least a two-side membrane anode modular unit.

4. Method for electrolytic deposition of a zinc-nickel alloy layer on a substrate to be treated as recited in claim 3 characterized in that the at least two-side membrane anode modular unit provides at least a first encapsulation of the at least one first membrane, the at least one first anolyte compartment and the at least one anode by encapsulating the at least one first non-metallic front plate with the at least one non-metallic container; wherein the at least one first sealing element is sealing said at least first encapsulation of said at least one first non-metallic front plate with said non-metallic container; and wherein the at least two-side membrane anode modular unit further provides at least a second encapsulation of the at least second membrane, the at least second anolyte compartment and the at least one anode by encapsulating the at least second non-metallic front plate with the at least one non-metallic container; wherein the at least two-side membrane anode modular unit further comprises at least a second sealing element, which is sealing said at least second encapsulation of said at least second non-metallic front plate with said at least one non-metallic container.

5. Method for electrolytic deposition of a zinc-nickel alloy layer on a substrate to be treated as recited in claim 3 characterized in that the at least one anode can be individually removed from or inserted into the at least two-side membrane anode modular unit without that the entire at least two-side membrane anode modular unit has to be removed from or inserted into the at least one reaction tank.

6. Method for electrolytic deposition of a zinc-nickel alloy layer on a substrate to be treated as recited in claim 1 characterized in that the at least one first membrane is not in direct contact with each anode.

7. Method for electrolytic deposition of a zinc-nickel alloy layer on a substrate to be treated as recited in claim 1 characterized in that each membrane is a cation ion-exchange membrane and/or wherein each anode is an insoluble anode.

8. Method for electrolytic deposition of a zinc-nickel alloy layer on a substrate to be treated as recited in claim 1 characterized in that the at least one anode can be individually removed from or inserted into the at least two-side membrane anode modular unit without that the entire at least two-side membrane anode modular unit has to be removed from or inserted into the at least one reaction tank.

9. The method for electrolytic deposition of a zinc-nickel alloy layer on a substrate to be treated according to claim 1, wherein the membrane anode system further comprises:

at least a second non-metallic front plate having a plurality of openings, at least a second membrane, and at least a second anolyte compartment formed between the at least second membrane and the at least one anode;

at least a second sealing element;

wherein the at least one anode comprises at least a first side comprising a first anode surface and at least a second side comprising a second anode surface, and the at least first side of the anode is oppositely arranged to the at least one at least second side of the at least one anode, wherein the first side of the at least one anode is closer to at least one first membrane and the at least one first non-metallic front plate than the at least second side of the at least one anode, and the at least one first membrane and the at least first non-metallic front plate are arranged in a parallel manner to the first anode surface of said first side of the at least one anode, wherein the second side of the at least one anode is closer to the at least second membrane and the at least second non-metallic front plate than the first side of the at least one anode, and the at least second membrane and the at least second non-metallic front plate are arranged in a parallel manner to the surface of said at least second side of the anode, wherein the at least one first and second membranes together with the at least one first and second non-metallic front plates, the at least one non-metallic container, the at least one first and the second anolyte compartments, the at least one first and second sealing elements, and the at least one anode form together at least a two-side membrane anode modular unit, wherein the at least second membrane, the second anolyte compartment, and the at least one anode are encapsulated by the at least one second non-metallic front plate and the at least one non-metallic container, wherein the at least one second non-metallic front plate and the at least one non-metallic container are sealed to each other by the second sealing element.

10. Method for electrolytic deposition of a zinc-nickel alloy layer on a substrate to be treated according to claim 9 characterized in that the method comprises at least an anolyte feeding system for controlling and/or regulating of at least one an anolyte volume flow for providing at least one an anolyte to the at least first anolyte compartment or to the at least one first and second anolyte compartments of the membrane anode system; wherein said anolyte feeding system comprises at least one anolyte tank, at least a dosing pump, and at least a dosing nozzle; wherein the anolyte volume flow is running from the at least one anolyte tank to the dosing pump, further to the dosing nozzle, and further to the at least one first anolyte compartment or to the at least one first and second anolyte compartments of the membrane anode system.

11. Method for electrolytic deposition of a zinc-nickel alloy layer on a substrate to be treated according to claim 10 characterized in that the anolyte feeding system is not using flow meters and ball valves for controlling and/or regulating the anolyte volume flow.

12. Method for electrolytic deposition of a zinc-nickel alloy layer on a substrate to be treated according to claim 11 characterized in that the anolyte volume flow is controlled and/or regulated in such a way that the anolyte feeding system is a closed circulating system, wherein the anolyte volume flow after leaving again the at least one first anolyte compartment or the at least one first and second anolyte compartments of the membrane anode system flows back to the at least one anolyte tank.

13. Method for electrolytic deposition of a zinc-nickel alloy layer on a substrate to be treated according to claim 10 characterized in that the anolyte volume flow is controlled and/or regulated in such a way that the anolyte feeding system is a closed circulating system, wherein the anolyte volume flow after leaving again the at least one first anolyte compartment or the at least one first and second anolyte compartments of the membrane anode system flows back to the at least one anolyte tank.

14. Method for electrolytic deposition of a zinc-nickel alloy layer on a substrate to be treated according to claim 10 characterized in that the anolyte is an aqueous liquid.

15. Method for electrolytic deposition of a zinc-nickel alloy layer on a substrate to be treated according to claim 10 characterized in that the anolyte is substantially free of any acids.

16. The method according to claim 1, wherein the at least one anolyte compartment contains an anolyte that is pure distilled water.

17. Method for electrolytic deposition of a zinc-nickel alloy layer on a substrate to be treated characterized in that the method comprises:

providing a membrane anode system comprising:

at least one reaction tank, at least one first membrane, at least one anode, at least one cathode, at least one first anolyte compartment formed between the at least one first membrane and the at least one anode, and at least one catholyte compartment, wherein the catholyte compartment contains a zinc and nickel electrolyte solution;

wherein the membrane anode system is characterized in that the at least one first membrane is arranged between the at least one anode and the at least one cathode, wherein the at least one first membrane has a distance to the anode ranging from 0.5 mm to 5 mm, and applying a current between the at least one anode and the at least one cathode to deposit the zinc-nickel alloy layer on the substrate, wherein the at least one anolyte compartment contains an anolyte that is pure distilled water.

18. Method for electrolytic deposition of a zinc-nickel alloy layer on a substrate to be treated characterized in that the method comprises:

providing a membrane anode system comprising:

at least one reaction tank, at least one first membrane, at least one anode, at least one cathode, at least one first anolyte compartment formed between the at least one first membrane and the at least one anode, and at least one catholyte compartment formed between the at least one first non-metallic front plate and the at least one cathode, wherein the at least one catholyte compartment contains a zinc and nickel electrolyte solution;

wherein the membrane anode system is characterized in that the at least one first membrane is arranged between the at least one anode and the at least one cathode, wherein the at least one first membrane has a distance to the at least one anode ranging from 0.5 mm to 5 mm, and applying a current between the at least one anode and the at least one cathode to deposit the zinc-nickel alloy layer on the substrate, wherein the at least one first anolyte compartment further comprises a plurality of openings in the at least one first non-metallic front plate having a plurality of openings and at least a non-metallic container, wherein said at least one first non-metallic front plate and said at least non-metallic container form together with the at least one first membrane, the at least one anode, and the at least one first anolyte compartment between the at least one first membrane and the at least one anode, at least a one-side membrane anode modular unit, and the anode can be individually removed from or inserted into the at least one-side membrane anode modular unit without that the entire at least one-side membrane anode modular unit has to be removed from or inserted into the at least one reaction tank, wherein the at least one anolyte compartment contains an anolyte that is pure distilled water.

* * * * *